United States Patent [19]

Eck

[11] Patent Number: 4,794,783

[45] Date of Patent: Jan. 3, 1989

[54] VEHICLE REPAIR AND ALIGNMENT RACK

[75] Inventor: Leonard F. Eck, McPherson, Kans.

[73] Assignee: Hein-Werner Corporation, Waukesha, Wis.

[21] Appl. No.: 22,281

[22] Filed: Mar. 5, 1987

[51] Int. Cl.[4] ..... B21D 1/12

[52] U.S. Cl. ..... 72/447; 72/705

[58] Field of Search ..... 72/705, 447; 187/8.47, 187/8.49, 8.5

[56] References Cited

U.S. PATENT DOCUMENTS

| | | | |
|---|---|---|---|
| 2,03,785 | 9/1935 | Merrill . | |
| 2,422,030 | 6/1947 | Merrill . | |
| 2,717,020 | 9/1955 | Dobias . | |
| 3,088,547 | 5/1963 | MacMillan . | |
| 3,269,169 | 8/1966 | Latuff et al. . | |
| 3,338,083 | 8/1967 | Eck . | |
| 3,377,834 | 4/1968 | Latuff et al. . | |
| 3,776,022 | 12/1973 | Lionello . | |
| 3,835,693 | 9/1974 | Majersky . | |
| 3,888,100 | 6/1975 | Chisum . | |
| 4,070,899 | 1/1978 | Venäläinen . | |
| 4,138,876 | 2/1979 | Chisum . | |
| 4,151,737 | 5/1979 | Specktor . | |
| 4,247,966 | 2/1981 | Labbe . | |
| 4,313,335 | 2/1982 | Eck . | |
| 4,398,410 | 8/1983 | McWhorter et al. | 72/705 |
| 4,445,665 | 5/1984 | Cray . | |
| 4,447,042 | 5/1984 | Masui . | |
| 4,574,614 | 3/1986 | Field . | |
| 4,592,225 | 6/1986 | Eck . | |
| 4,643,015 | 2/1987 | Larsonet al. | 72/705 |

FOREIGN PATENT DOCUMENTS

| | | | |
|---|---|---|---|
| 249933 | 3/1962 | Australia . | |
| 1939618 | 2/1971 | Fed. Rep. of Germany . | |
| 2412499 | 8/1979 | France | 72/705 |

OTHER PUBLICATIONS

Super Bearcat Brochure (3 pages) (undated).

*Primary Examiner*—Lowell A. Larson

*Attorney, Agent, or Firm*—Wm. Bruce Day

[57] ABSTRACT

A vehicle repair and alignment rack for correcting and aligning misshapened vehicle frame and body portions comprises a rack structure having a vehicle supportive upper surface and a lower surface with opposite side rack portions having inner and outer flanges joined together to form a central opening, whereby a vehicle straddles the opening for work access to the vehicle underside. Front and rear supportive legs are affixed to the rack structure for elevation above a floor surface and have power fluid rams operatively connected thereto for folding the legs and lowering the rack structure to the floor to facilitate positioning a vehicle on the rack. Force supplying members are affixed to the rack structure and are easily movable therearound so that they can be selectively positioned to exert pulls on substantially any part of the vehicle. A front end of the rack structure is removable and replaceable so that the repairman has easy access to the lower front side of the vehicle, a common location for vehicle damage.

12 Claims, 6 Drawing Sheets

VEHICLE REPAIR AND ALIGNMENT RACK

FIELD OF THE INVENTION

This invention relates to vehicle straightening and alignment structures, and in particular to a work rack for use in alignment and straightening systems.

BACKGROUND OF THE INVENTION

Work rack structures for correcting damaged, misaligned and misshapened vehicle frame and body parts often include a complex bridgework of vertical and horizontal beams which cause obstructions that interfere with access to the vehicle, and particularly with access to the underside of the vehicle. Such work racks are often associated with force supplying units, power beams or the like which exert a force, normally a pull, on a selected portion of the vehicle for correcting the improper condition. The force supplying units are generally not movable or positionable relative to the work rack, making it difficult to exert force in a desired direction. Moreover, the configuration of vehicle work racks typically requires that the vehicle be taken off of the rack, turned around and repositioned on the rack for corrections to the opposite end of the vehicle. Accordingly, many work racks have restricted access to the front end of a vehicle, where damage frequently occurs, as in the case of front end collisions. Because of this, such racks were often unhandy to use and the time in repair necessarily accounted for restricted access to the portion of the vehicle which needed repair.

OBJECTS OF THE INVENTION

The objects of the present invention are: to provide a vehicle work rack which provides ease of access to any damaged area of the vehicle or t an area of the vehicle to be worked upon; to provide such a work rack having a central interior opening without interfering beams or other obstructions across the opening and providing easy access to the underside of the vehicle; to provide such a work rack having force supplying members mounted on the rack and which are movable completely around the work rack for exerting a force on substantially any portion of the vehicle; to provide such a work rack with force supplying members having sufficient work capacity to accomplish a variety of body and frame alignment tasks; to provide such a work rack having removable and replaceable front end members to provide the workman with access to the front end of a vehicle situated on the rack; to provide such a work rack having force supplying members which are efficiently powered by power fluid rams for relatively rapid pulling action and to quickly correct improper conditions in vehicle frame and body parts; to provide structure by which the force supplying members may pass over the removable and replaceable bridge member in the front end of the rack; and to provide such a work rack which is efficient and sturdy in use, adaptable for a variety of uses and suited for its intended purpose.

Other objects and advantages of this invention will become apparent from the following description taken in connection with the accompanying drawings wherein are set forth by way of illustration and example, certain embodiments of this invention.

DESCRIPTION OF THE PREFERRED AND ALTERNATE EMBODIMENTS

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
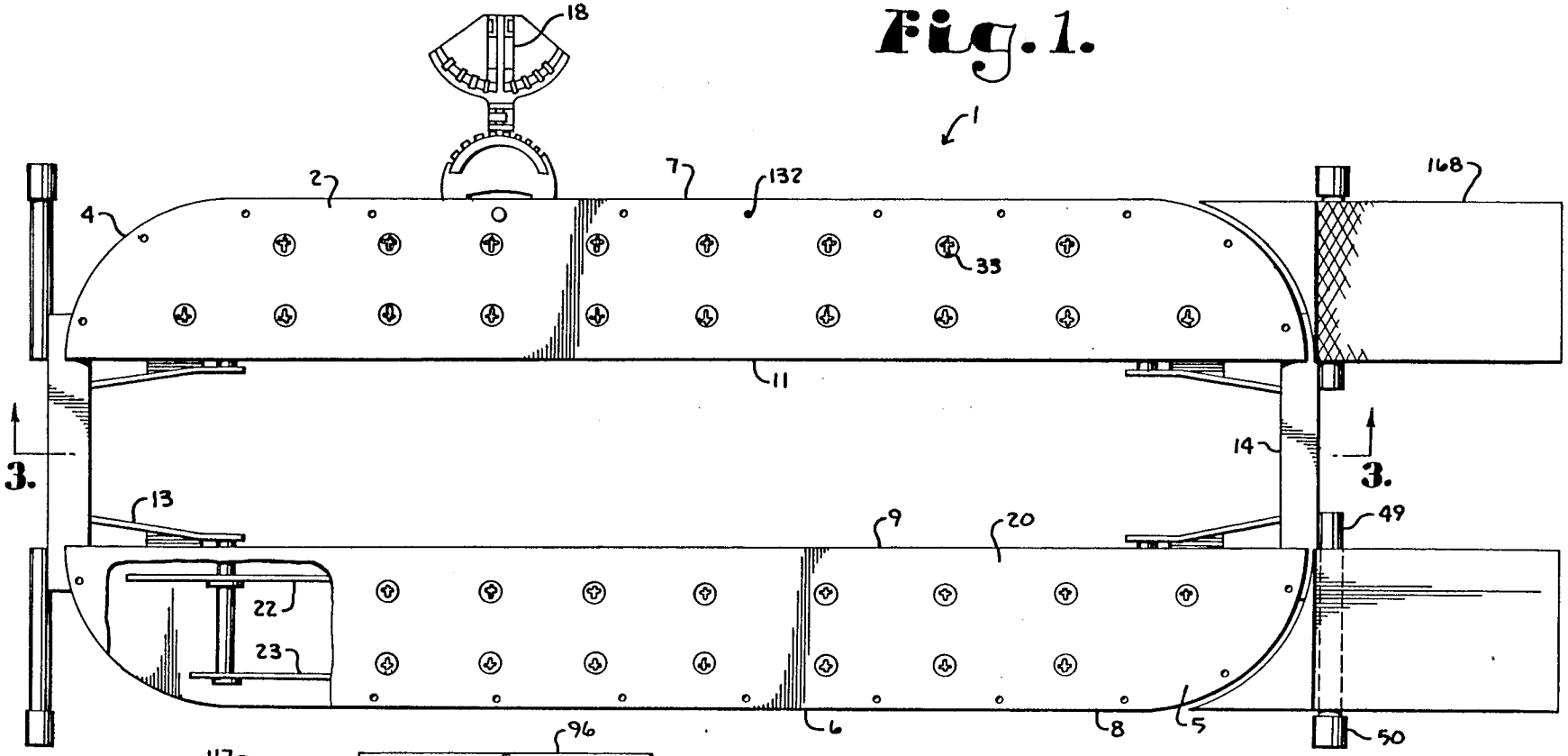
FIG. 1 is a plan view of vehicle work rack embodying the present invention and shown in a lowered position to facilitate positioning a vehicle on the rack.
Figure 14:
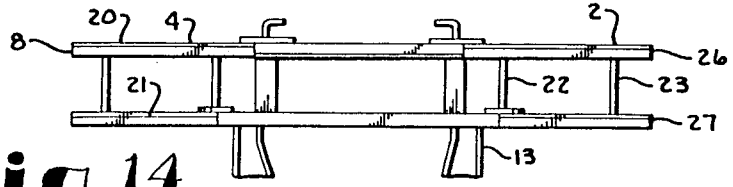
FIG. 14 is a fragmentary, end elevational view of the rack showing the bridge member in place.
Figure 12:
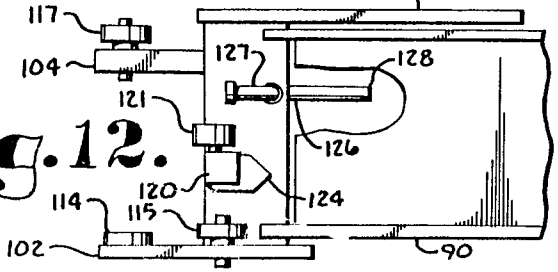
FIG. 12 is an enlarged, fragmentary view of a detail of the connection between the pull tower and the rack.
Figure 2:
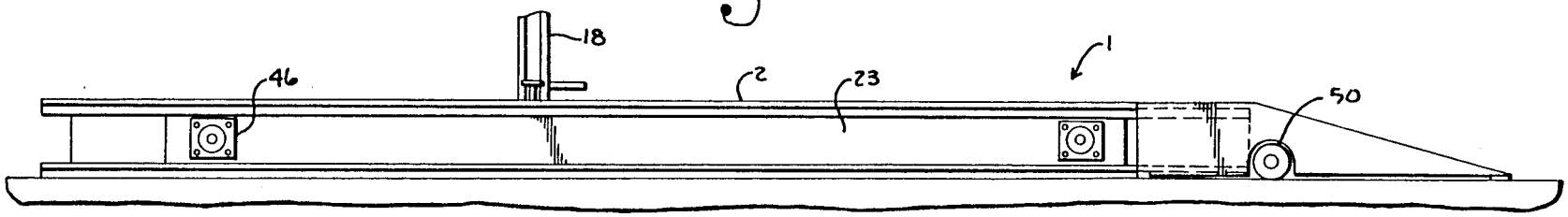
FIG. 2 is a side elevational view of the work rack lowered to a floor surface.
Figure 4:
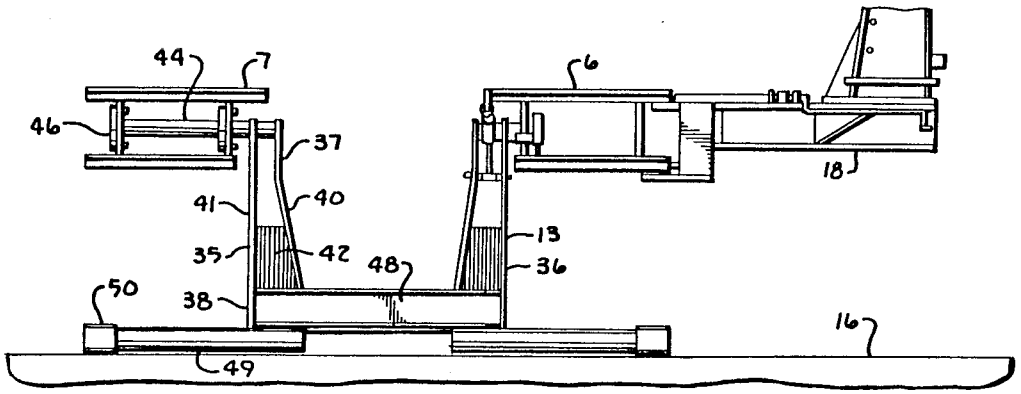
FIG. 4 is an end elevational view of the vehicle work rack and showing an end bridge member removed.
Figure 3:
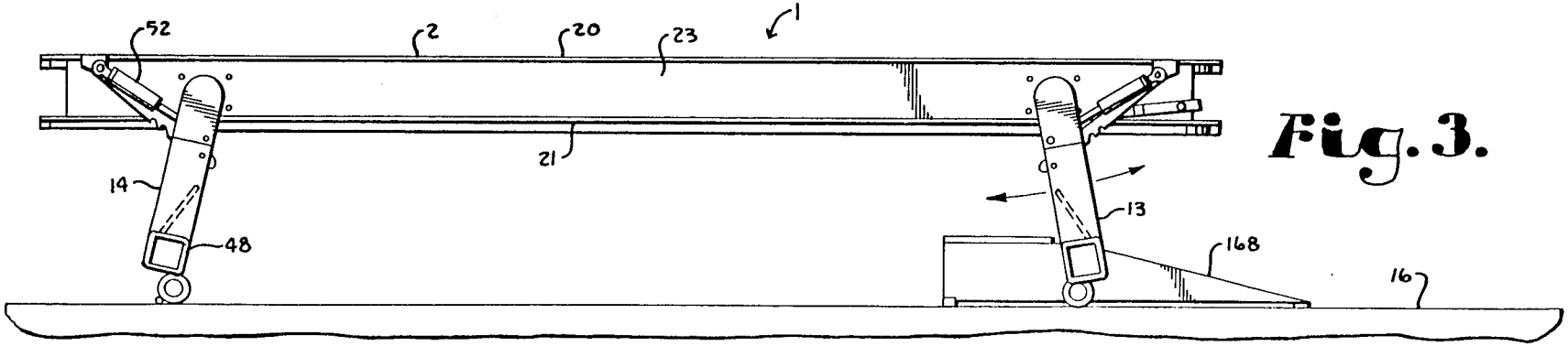
FIG. 3 is a side elevational view of the work rack raised to a working height.

Referring more in detail to the drawings:

The reference numeral 1, FIG. 1, generally indicates a work rack embodying the present invention and used for correcting damaged, misshapened or misaligned vehicle frame and body parts. The work rack 1 includes a rack structure 2 having an upper surface adapted for supporting a vehicle thereon and having front and rear end rack portions 4 and 5 and opposite side rack portions 6 and 7. The rack structure 2 generally has a substantially oval outer periphery 8 and an inner periphery 9 forming a central opening 11 whereby the vehicle straddles the opening 11 to provide ease of work access to the vehicle underside. Front and rear supportive sets of legs 13 and 14 are affixed to the rack structure 2 for elevation above a shop floor 16, FIGS. 3 and 4.

At least one force supplying structure, such as in the form of a pull tower 18, is affixed to the rack structure 2 and includes means for varying the position of the pull tower 18 about the outer periphery 8 of the rack structure 2 for selective translation and positioning, whereby a force, such as a pull may be exerted on virtually any selected area of the vehicle.

In the illustrated example, the rack structure 2 is elongate and generally oval in shape when viewed from above, FIG. 1. Front and rear end portions 4 and 5 are generally semi-circular in shape with the opposite side rack portions 6 and 7, the latter being generally straight and parallel in relationship, whereby the central opening 11 is situated between the front and rear end rack portions 4 and 5 and the side rack portions 6 and 7 and is generally elongate in shape. Each of the side rack portions 6 and 7 has upper and lower plates 20 and 21 secured together by welding or the like in vertically spaced relationship by inner and outer webs 22 and 23.

As part of the connecting means for attachment of the pull tower 18 to the rack structure 2, the rack structure 2 includes upper and lower rails 26 and 27 which extend about the outer periphery 8 of each of the side rack portions 6 and 7 at the outer edge of both the upper plate 20 and lower plate 21. The rails 26 and 27 are generally square in cross section, welded at the plate margin, and include inner, outer and lower surfaces 28, 29 and 30 for engagement with various parts of the pull tower 18 as described below.

To provide anchors for various chains or other suitable tension members used with the pull towers 18, the rack structure 2 has a plurality of receptacles 33 i the upper plate 20 and arranged in double rows whereby each receptacle 33 is substantially in the form described and shown in connection with my earlier U.S. Pat. No. 4,313,335, incorporated herein by reference.

The front and rear sets of legs 13 and 14 are affixed to the rack structure 2 to position it above the shop floor 16 and in the illustrated example, both sets of legs are hingely connected to the rack so that the rack can lower completely to the floor so that a vehicle can be easily driven or winched on to the rack. In the illustrated example, each set of legs 13 and 14 has spaced, opposite legs 35 and 36 with upper and lower ends 37 and 38. Each of the legs 35 and 36 is formed of spaced leg plates 40 and 41 connected by an intermediate web 42. At the upper end 37, each leg 35 and 36 is connected to the applicable side rack portion 6 and 7 by respective hinge pins 44 which extend through the upper ends of both leg plates 40 and 41 and through both inner and outer webs 22 and 23 of the side rack portions 6 and 7. The hinge pins 44 are weldably connected to the upper ends of the leg plates 40 and 41 and are rotatably supported by bearing assemblies 46 through the webs 22 and 23 for rotation relative to the side rack portion. The lower ends 38 of the legs 35 and 36 are joined by a connector beam 48 in the form of a box and providing a hollow, interior reservoir for pressurized air, as later described. Roller supporting outriders 49 are weldably affixed to the outer ends of the connector beams 48 and extend outwardly to provide a wide base of support for the rack structure 2. Wheels 50 are rotatably mounted to the outer ends of the outriders 49 and roll upon the floor surface as the sets of legs 13 and 14 swing upwardly and downwardly.

Figure 5:
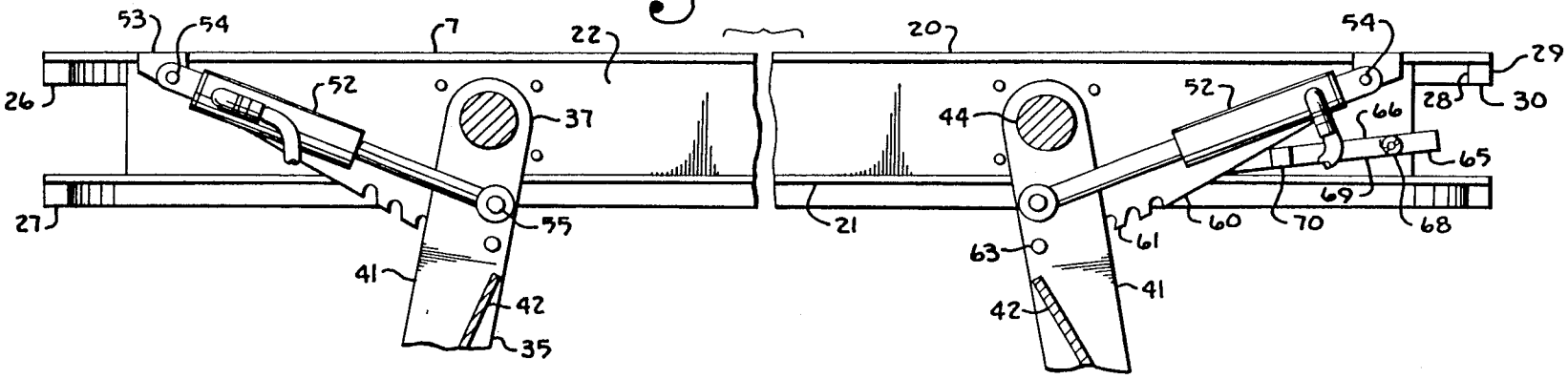
FIG. 5 is an enlarged, fragmentary view showing connections of the legs to the work rack.

Means for folding the front and rear sets of legs 13 and 14 relative to the rack structure 2 are provided, and in the illustrated example, FIG. 5, include power fluid rams 52 having one end affixed by a pin 54 to an ear 53 secured to the upper plate 20 at the inner periphery 9. The other end of the ram 52 is pivotally secured to a pin 55 extending between the leg plates 40 and 41 and situated below the connection to the hinge pin 44. The rams 52 for the front and rear sets of legs members 13 and 14 are oppositely extended, FIG. 5, so that the sets of legs 13 and 14 swing oppositely, or toward their respective end portions 4 and 5. This enables the rack structure 2 to rise substantially vertically from the floor surface and not swing forwardly or rearwardly as a parallelogram.

The rams 52 for the front and rear sets of legs 13 and 14 are connected to suitable sources of pressurized hydraulic fluid, such as an air over hydraulic fluid system wherein shop air drives a hydraulic pump which in turn supplies pressurized fluid through appropriate valves to route fluid to the rams 52. As is common in the trade, these valves are normally foot pedal operated and the operator, through manipulation of the foot valves, attempts to cause the rack structure 2 to raise and lower as levelly as possible. Because one end of the rack is normally heavier than the other end of the rack, as caused by positioning a front engine, front wheel drive vehicle on the rack, the front end of the rack will tend to rise significantly slower than the rear end of the rack and the rear end will have to be stopped from rising, through operation of the appropriate valve, to permit the front end to "catch up" so that the rack does not become excessively tilted.

Safety catch arms 6 are swingably mounted adjacent certain of the power fluid rams 52. In the illustrated example, the arms 60 are mounted at their upper ends by the pin 54, the same pin that secures the upper end of the ram 52. The lower end of the safety catch arm 60 has a coxcomb arrangement of teeth 61 thereon, which selectively engage a pawl 63 extending between the leg plates 40 and 41. In its down position, the safety catch arms 60 engages the pawl 63 and prevents the appropriate foot member 13 or 14 from retraction. When the arm 60 is lifted, by means hereafter described, the foot member 13 or 14 is free to pivot upon operation of the ram 52 and permit the leg to retract and the rack structure 2 to lower. In the illustrated example, safety catch arms 60 are located at the front and rear end portions 4 and 5 and on the side rack portion 7. It is not necessary that opposite legs 35 and 36 of the sets of legs 13 and 14 have safety catches therewith, but only that one of the two sides of the sets of legs 13 or 14 have a safety means therewith.

Figure 7:
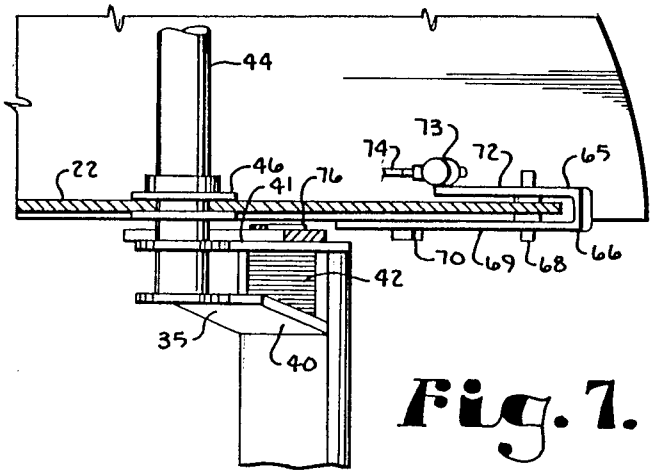
FIG. 7 is a sectional view taken along lines 7—7, FIG. 6.
Figure 6:
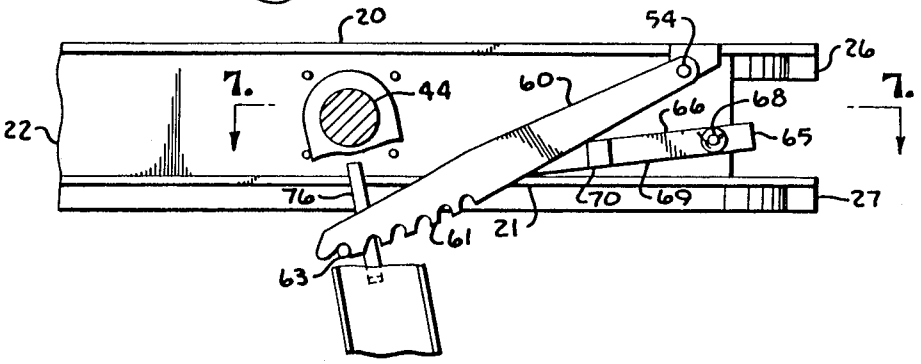
FIG. 6 is a fragmentary view showing further details of the leg-work rack connection.
Figure 9:
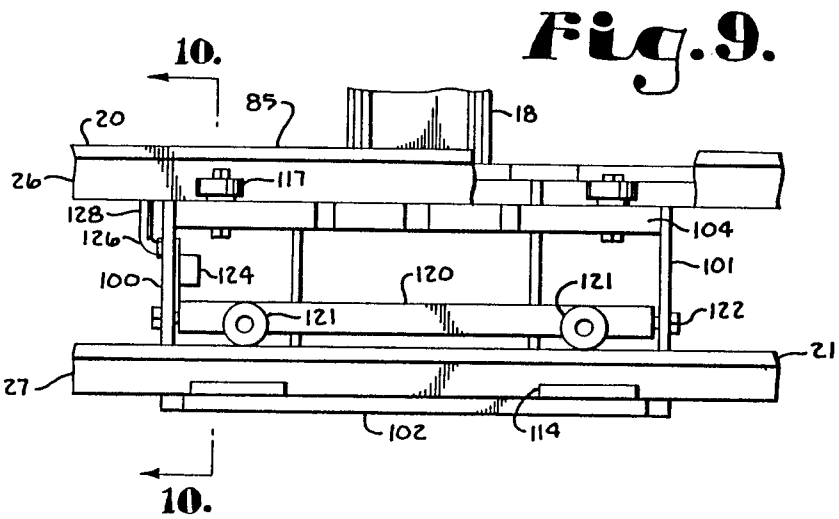
FIG. 9 is a fragmentary view of the connection details of a pull tower connected to the rack.
Figure 8:
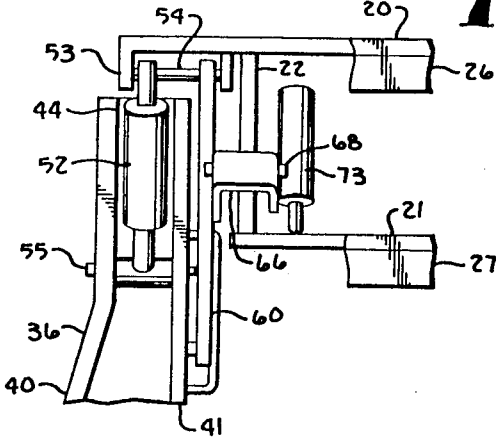
FIG. 8 is an enlarged, detailed view of the connection between the work rack leg and the supporting structure therefore.

To disengage the teeth 61 of the safety catch arm 60 from the pawl 63, disengagement means are used. In the illustrated example, FIGS. 5, 6 and 7, a disengagement means 65 includes a U-shaped bracket 66 which is pivotally connected at the end of the inner web 22 by a pin 68. One limb 69 of the bracket 66 carries a block 70 that contacts the safety catch arms 60 and located at the end of the other limb 72, FIG. 7, is a pneumatically operated plunger 73 with connection to an air line 74.

In operation, pressurized air is selectively provided through the air line 74 and the plunger 73 extends and contacts the lower plate 21. As the plunger 73 extends, the block 70 on the bracket 66 contacts and lifts the safety catch arms 60, disengaging the teeth 61 from the pawl 63. Note that as shown in FIG. 5, the pawl 63 extends from the leg plate 41 toward the side rack portion 7 and has a guide 76 attached to the back surface of the leg plate 41 adjacent the pawl 63 and receives the distal end of the safety catch arm 60 to ensure that the arm stays in alignment with the pawl 63.

Figure 11:
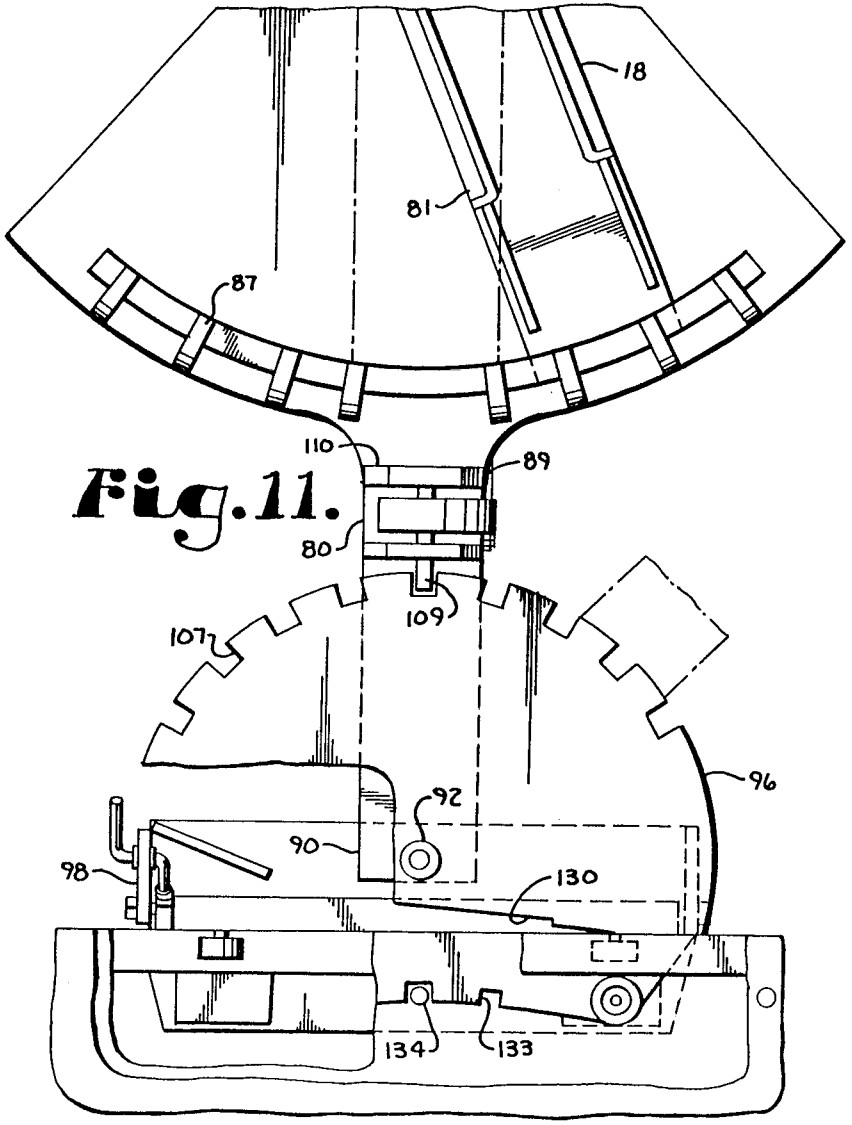
FIG. 11 is a fragmentary, plan view of the details of connection between a pull tower and the rack.

The work rack 1 includes at least one pull tower 18 affixed to the rack structure 2 and translatable therearound as desired t position the same for force exerting operations upon a vehicle. In the illustrated example, FIG. 1, the rack structure 2 has only one pull tower 18, however, it is intended for the work rack to include four pull towers, as that number provides sufficient coverage during vehicle correction operations. An exemplary pull tower 18 is shown in connection with my earlier U.S. Pat. No. 4,313,335, incorporated herein by reference. Each pull tower 18 generally consists of a base 80 which mounts on to the rack structure 2 and a tower 81 situated upon the base 80 and containing hydraulic rams, pulleys, guides and chains sufficient to attach to a vehicle at a selected location and make a pull on that location to correct damage or misalignment. The base generally includes a connection end 82 which attaches to the rack structure 2 and a remote end 83 with the tower 81 swivelly mounted to the remote end 83 by a pivot pin 84. The tower 81 is mounted upon a swivel plate 85 which is held down at its forward end by a series of claws 87. The pull tower 18 has a neck 89 terminating at a forward end 90, FIG. 11, pivotally secured to a pull tower mount 93 by a pivot pin 92. A front web 94 closes the forward end 90 of the pull tower 18.

A radius plate 96, affixed atop a forward mounting means 98, is connected by the pivot pin 92 to the pull tower forward end 90 and includes opposite end plates 100 and 101, a bottom plate 102, the top radius plate 96, and an upper crossbar 104, thereby comprising a substantially rectangular or box structure. The mounting means 98 and the tower 81 pivot relative to each other, via the pivot pin 92, and a relative angle can be fixed by the use of a lock arrangement 106. Included in the lock arrangement 106 are a plurality of indents 107 about the periphery of the radius plate 96 and a spring biased lock rod 108 with a protruding pawl end 109 which is inserted into one of the indents 107. The lock rod 108 extends through spaced ears 110 for guides and to adjacent the pin 84. A pivotally mounted handle 111 is used for grasping and retracting the pawl end 109 so that the tower 81 may swing relative to the radius plate 96.

Figure 10:
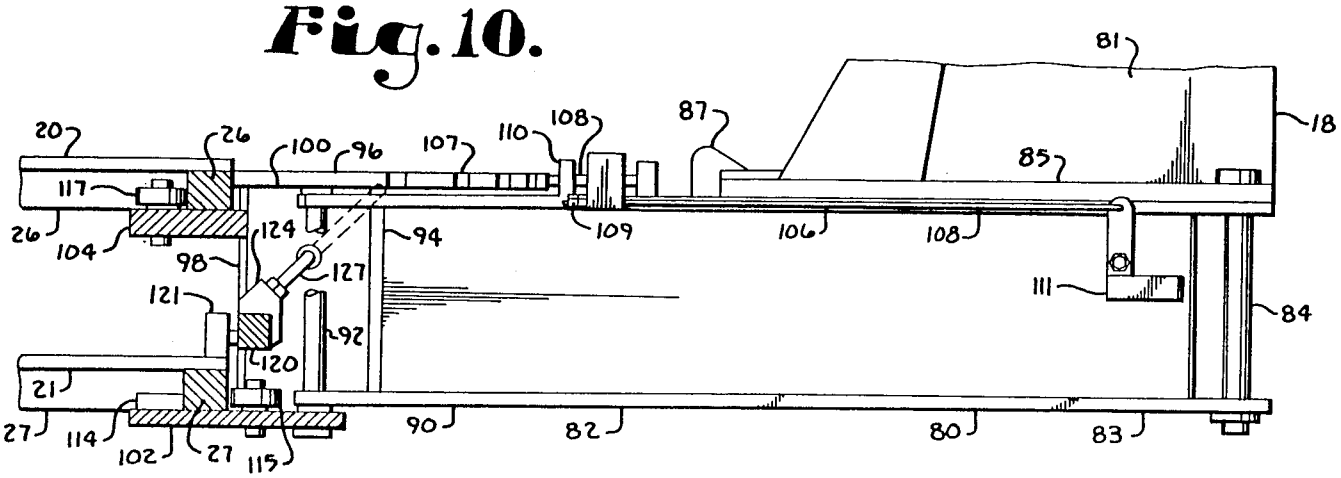
FIG. 10 is a sectional view taken along lines 10—10, FIG. 9.

To mount the pull tower 18 on the rack structure 2, the mounting means 98 is used. Shown in FIG. 10, the bottom plate 102 and the crossbar 104 protrude outwardly of the end plates 100 and 101 to the point where they are positioned generally under the respective upper and lower rails 26 and 27. The bottom plate 102 includes a slide block 114 positioned against an interior surface of the lower rail 27 and spaced bottom rollers 115 abutting the outer surface of the lower rail 27. The crossbar 104 extends under the upper rail 26 and has upper rollers 117 abutting the inside surface of the upper rail 26. The bottom plate 102 and the upper crossbar 104, with their accompanying rollers and slide blocks 114, 115 and 117, permit the pull tower 18 to slide about the periphery of the rack structure 2.

To secure the pull tower 18 to the rack structure 2, an intermediate crossbar 120 is utilized and extends between the end plates 100 and 101 and is positioned immediately adjacent and above the bottom rollers 115. The intermediate crossbar 120 carries intermediate rollers 121 which roll upon the upper surface of the rack lower plate 21 immediately above the lower rail 27. The intermediate crossbar 120 is pivotally mounted at its opposite ends by bolts 122. A lock plate 124 extends upwardly from the intermediate crossbar 120 adjacent the end plate 100 and swings into and out of an upright position, FIG. 10, as the intermediate crossbar 120 is rotated, as by manipulation of the bolts 122. To lock the crossbar 120 in position, a locking arm 126 extends through the end plate 100 and has an inner arm segment 127 contacting the lock plate 124 and an outer arm segment 128 extending to the exterior of the end plate 100 for manipulation by an operator. The operator may swing the outer arm segment 128 to cause the inner arm segment 127 to move out of locking position to the lock plate 124, then permitting the operator to rotate the intermediate crossbar 120.

To remove and replace the pull tower 18 from the rack structure 2, the pull tower 18 is first supported, as by an overhead hoist and chain, and the locking arm 126 manipulated and the intermediate crossbar 120 rotated to remove the intermediate roller 121 from locking engagement with the upper surface of the lower plate 21. This permits the mounting means 98 portion of the pull tower 18 to be dropped downwardly and disengaged from the upper and lower rails 26 and 27. Then, the pull tower 18 is moved away from the rack structure 2 for appropriate repairs or disassembly.

Figure 13:
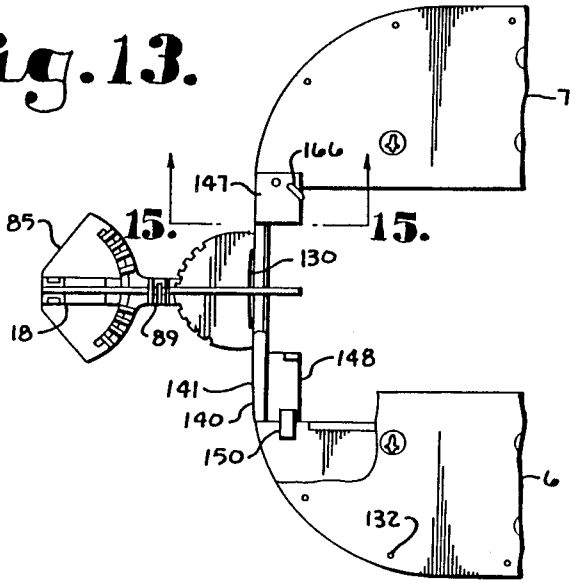
FIG. 13 is a plan view showing the pull tower moving between sides of the rack and situated upon the bridge member.

Once mounted on the rack structure 2, the pull tower 18 is free to move around the periphery thereof, even to the curved corners of the rack because of the concave curvature 130 of the radius plate 96, FIG. 13. To lock the pull tower 18 in position at a selected location about the periphery of the rack structure 2, various means are employed. One such means includes apertures 132 bored through the periphery of the rack, FIG. 1, and which are aligned with indents 13 extending into a lower concave curvature 135 formed in the bottom plate 102.

Figure 15:
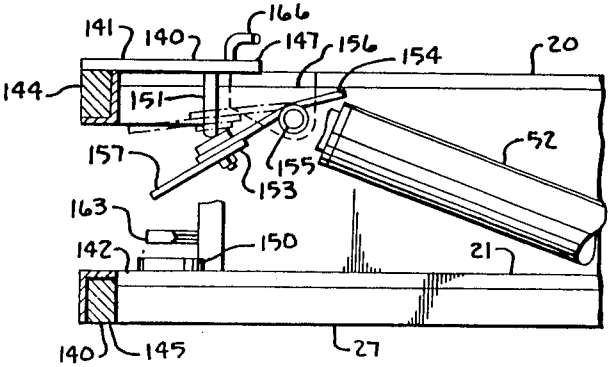
FIG. 15 is an enlarged, sectional view taken along lines 15—15, FIG. 13.
Figure 16:
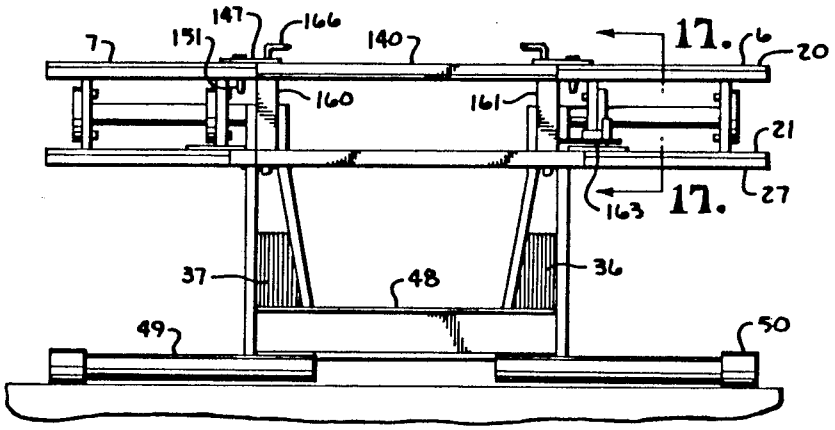
FIG. 16 is a cross sectional view taken transversely of the rack.
Figure 17:
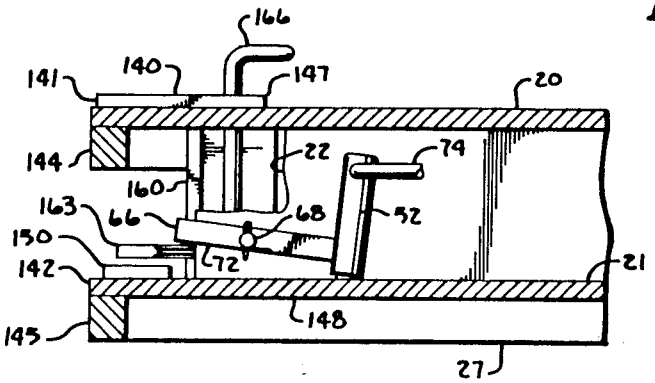
FIG. 17 is an enlarged sectional view taken along lines 17—17, FIG. 16.

Spanning the openings between the space side rack portions 6 and 7 at the front or rear end portions 4 and 5 is a selectively removable and replaceable bridge 140, FIGS. 15, 16 and 17. The bridge 140 includes a track means including parallel upper and lower bars 141 and 142 with upper and lower rails 144 and 145 extending therefrom and matching the upper and lower rack rails 26 and 27. Spaced upper plates 147 are at opposite ends of the upper rail 144 and spaced lower plates 148 are on opposite ends of the lower rail 145. The upper and lower plates 147 and 148 provide connection means for attachment to the rack structure 2. In the illustrated example, tabs 150 are affixed to the lower plates 148 and a portion thereof extends over the lower plates 21 at the end portion 4 or 5. The upper plates 147 are affixed atop the ends of the upper bar 141 and extend over the adjoining portion of the side rack upper plate 20. For smooth rolling of the intermediate rollers 121, the lower plates 148 are generally level with the lower plate 21 and the tabs 150 are set back from the path of travel of the intermediate roller 121.

To secure the bridge 140 in place, pins 151 are affixed to the upper plates 147 and extend down through bores in the upper plate 20. The pins 151, when in place, also displace a means providing an obstruction to travel of the pull tower 18 on the bridge 140. Normally, stop means 153, FIG. 15, prevent travel of the pull tower 18 past the edges of the side rack portion 6 and 7, for if the bridge 140 was not in place, the pull tower 18 would fall on the rack structure 2 and could injure a workman standing nearby. To prevent this occurence, the stop means 153 includes a spring 154 coiled about a pin 155 secured to an ear 156 depending from the underside of the upper plate 20. A remote end of the spring 154 carries an arm 157 which, because of the action of the spring 154, is urged to an upright position in the absence of any force urging it downwardly. When the bridge pins 151 are inserted, as by lifting the bridge into position, the pins 151 engage the arm 157 and urge the stop means 153 downwardly and away from the path of travel of the upper rollers 117. There are stop means 153 on opposite ends of the side rack portion 6 and 7.

Figure 18:
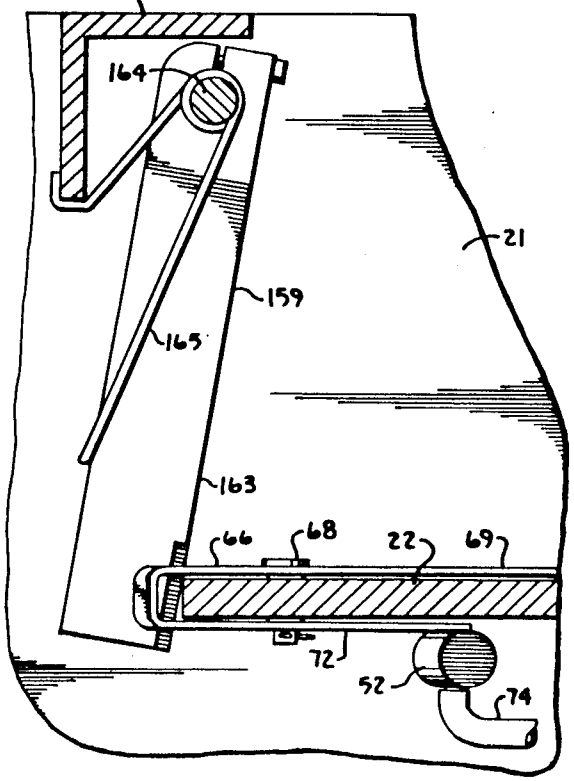
FIG. 18 is an enlarged plan view of the structure shown in FIG. 17.

Because the bridge 140, when in place upon the front end portion 4 of the rack structure 2 interferes with lowering of the rack, a lowering lock out 159, FIG. 18, is provided. Spaced uprights 160 and 161 extend between the upper and lower bars 141 and 142 of the bridge 140 and the lowering lock out 159 consist of a blade 163 pivotally mounted on a rod 164 and spring loaded by a spring 165 to a forward position. The upper end of the rod 164 extends upwardly from the upper plate 147 and is turned to provide a hand hold 166. Rotating the hand hold 166 rotates the blade 163 against the pressure of the spring 165 and removes the blade from a blocking position. Rotating the hand hold 166 also permits the bridge 140 to be removed from the end of the rack structure 2. When the bridge 140 is in place on the rack and the hand hold 166 released, the spring 165 urges the blade 163 into blocking contact with the U-shaped bracket 66 and prevents lifting of the safety catch arms 60, thereby preventing rotation of the rack legs.

Finally, ramps 168 fit over the leg outriders 49 at the rear end portion 5 to permit a vehicle to be driven on to the rack structure 2.

The work rack 1 may typically include shop air lines routed about the rack with outlets at handy locations for use by a repairman. Also, lighting means for the illuminification of the underside of the vehicle including wiring and lightbulbs may be connected to the rack.

In the operation of the work rack 1, a vehicle is positioned on the rack structure 2, secured thereon by tiedowns or other chaining methods extending from the vehicle to the tiedown receptacles 33. The rack is raised by actuation of appropriate control means (not shown). These include air over hydraulic pumps with lines connected to the rams 52 to cause the front and rear foot members 13 and 14 to swing in opposite direction so that the rack lowers straight downwardly. In the usual situation, the rams 52 at the front and rear ends of the rack structure 2 are not interconnected but operated by separate pumps and the operator actuates the pumps to cause the rack to stay reasonably level as it is either raised or lowered. Because the weight of the vehicle upon the rack is seldom evenly distributed, normally, one end, the heavy end, of the rack must be raised prior to the other end of the rack and then the pump for the other end of the rack actuated to allow the light end to catch up to the heavier end.

Once the vehicle is elevated above the floor surface by the raising of the rack structure 2, the vehicle is ready to be worked upon to repair damage or for alignment. To accomplish this task, the pull towers 18 are moved about the periphery of the rack structure 2 and positioned as required. The pull towers 18 may be moved from one side rack portion to the other side rack portion by mounting the bridge 140 in place and moving the pull tower 18 over the bridge 140. While pulls cannot be made when the pull tower 18 is positioned on the bridge 140, because the bridge is too weak to restrain the forces exerted by the pull tower 18, the bridge 140 provides an easy way for the pull towers 18 to be positioned from one side of the rack to the other. When the bridge 140 is removed, the rack provides substantially free or unlimited access to the underside of the vehicle whereby the workman does not have to crawl under the work rack to gain access to the vehicle. Because front end damage frequently occurs in collisions, the vehicle front end is substantially unobstructed for ease of access.

For ease of maintenance on the pull towers 18, the towers are easily removed from the rack structure 2 as set forth above by manipulation of the locking arm 126 and rotation of the intermediate crossbar 120. The pull towers 18 may be removed while the rack is either in the raised or lowered position, or in any intermediate position.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A work rack for vehicles comprising:

(a) spaced, parallel beam members having a vehicle supportive upper surface and opposite end portions, said beam members having an opening therebetween located at least at one of said end portions;

(b) a pull tower unit mounted to said beam members and including a carriage with movable mounting means for translatory movements about a periphery of said beam members for exerting pulls on selected parts of a vehicle situated thereon; and (c) a bridge member extending across said opening at said end portions and having track means for translation of said pull tower unit thereon, said bridge member including means for removal and replacement from said beam members.

2. The work rack set forth in claim 1 including:

(a) stop means mounted on said beam members adjacent said opening and blocking translation of said pull tower unit when said bridge member is removed; and (b) said bridge member includes means engageable with said stop means and urging said stop means from a path of translation of said pull tower unit.

3. The work rack set forth in claim 2 wherein:

(a) said stop means includes a pivotally mounted lever arm and biasing means urging said level arm into the path of translation of said pull tower to block same; and (b) said bridge member includes means engageable with said lever arm to urge said lever arm from said path of translation when said bridge member is emplaced between said beam members.

4. A mobile work rack for vehicles comprising:

(a) spaced, parallel beam members having opposite end portions with openings therebetween at each of said end portions;

(b) said beam members having vehicle supportive upper plate surfaces and upper and lower peripheral rails;

(c) front and rear sets of legs with upper ends connected to said beam members by pivot means and with lower ends connected to cross beams extending between front and rear sets of legs; said cross beams providing structural connection and rigidity to resist lateral movement of said beam members;

(d) fluid power means extending between said beam members and said legs for opposite direction folding of said legs and upward and downward movement of said beam members;

(e) a pull tower unit mounted to said beam members upper and lower peripheral rails and including a ram mounted to a carriage and means projecting from said carriage engaging said upper and lower peripheral rails for movement along the length of said beam members;

(f) a bridge member for extending between said beam members opposite end openings and having upper and lower rails joining the upper and lower peripheral rails of said beam members for movement of said pull tower unit between said beam members; and (g) means removably and replaceably mounting said bridge member between said beam members.

5. The mobile work rack set forth in claim 4 including:

(a) a stop arm mounted in said beam members at said opposite end portions adjacent said upper and lower peripheral rails and having biasing means therewith urging said stop arm into a path of movement of said pull tower unit to block movement thereof; and (b) means mounted on said bridge member engaging said stop arm and urging same from said path of movement of said pull tower unit when said bridge member is mounted between said opposite end portions whereby said pull tower unit is transferred to said bridge member.

6. A pull tower unit for attachment to a work rack having upper and lower peripheral rails with respective inner, outer and upper surfaces and comprising:

(a) a carriage having a pull tower extending upwardly therefrom;

(b) a tongue portion of said carriage;

(c) upper and lower wheels and wheel support means extending from said tongue portion and engageable with said upper and lower peripheral rails; said upper and lower wheels respectively engaging inner and outer surfaces of said peripheral rails for rolling thereon; and (d) a retainer wheel and wheel support engaging an upper surface of one of said peripheral rails.

7. The pull tower unit set forth in claim 6 wherein:

(a) means pivotally mount said retainer wheel support to said carriage tongue portion whereby said retainer wheel swings into and out of engagement with said rails upper surface for attachment and removal of said pull tower from said work rack.

8. The pull tower unit set forth in claim 7 wherein:

(a) said upper wheel engages the inner surfaces of the upper peripheral rail;

(b) said lower wheel engages the outer surface of the lower peripheral rail and said wheel support of said lower wheel includes means engaging the inner surface of said lower peripheral rail; and (c) said retainer wheel engages the upper surface of said lower peripheral rail.

9. The pull tower unit set forth in claim 7 wherein:

(a) said means pivotally mounting said retainer wheel support to said carriage tongue portion include a bar bearing said retainer wheel and an axle and rotatably mounted in said tongue portion; and (b) a safety latch is mounted adjacent said bar and includes a tab extending from said bar and selectively engageable with an abutment arm mounted in said tongue portion; said abutment arm having a handle extending therefrom for manipulation of said abutment arm into and out of a path of rotation of said tab to permit rotation of said bar and disengagement of said retainer wheel from said lower peripheral rail.

10. A mobile work rack for vehicles comprising:

(a) spaced, parallel beam members separated from each other their entire length to provide a substantially unobstructed elongate opening open at front and rear ends;

(b) front and rear sets of legs with upper ends connected to said beam members by pivot means and with lower ends connected to cross beams extending between front and rear sets of legs; said cross beams providing structural connection and rigidity to resist lateral movement of said beam members;

(c) fluid power means extending between said beam members and said legs for opposite direction folding of said legs and upward and downward elevation of said beam members;

(d) a pull tower mountable to said beam members and including a base, a ram structure, and a tongue projecting from said base and slideably affixed to one of said beam members for translation therealong; and (e) a bridge member for extending between said beam members spaced front and rear ends and including means for translation of said pull tower thereon; said bridge member including means for removal and replacement for access between said beam members.

11. A mobile work rack for vehicles comprising:

a. means for supporting a vehicle including a peripheral margin with spaced rail means;

b. leg means connected to said means for supporting a vehicle for raising and lowering thereof; and c. pull tower means mounted to said means for supporting a vehicle and including an outwardly extending carriage means substantially coplanar with said means for supporting a vehicle, said carriage means having an outer portion with said pull tower upstanding therefrom and free standing at a pull tower upper end, and having an inner portion transitorily affixed to said peripheral margin by means connected to said spaced rail means, said pull tower having a ram structure therewith and a tensile member for making a pull on a vehicle.

12. A mobile work rack for vehicles comprising:

a. spaced, parallel beam members providing a substantially unobstructed elongate opening open at least at one end;

b. front and rear sets of legs supporting said beam members above a floor surface;

c. a pull tower mountable to said beam members and including a base, a ram structure and a tongue projecting from said base and slidably affixed to one of said beam members for translation therealong; and d. a bridge member for extending between said beam members and including means for translation of said pull tower thereon; said bridge member including means for removal and replacement for access between said beam members.

* * * * *